United States Patent [19]

Difflipp et al.

[11] Patent Number: 4,841,861

[45] Date of Patent: Jun. 27, 1989

[54] SHIFTING GEAR FOR THE INKBOX OF A PRINTING PRESS

[75] Inventors: Kurt Difflipp, Steinberg; Heinrich Ochs, Sinntal, both of Fed. Rep. of Germany

[73] Assignee: M.A.N. Roland, Offenbach AM Main, Fed. Rep. of Germany

[21] Appl. No.: 112,251

[22] Filed: Oct. 22, 1987

[30] Foreign Application Priority Data

Oct. 22, 1986 [DE] Fed. Rep. of Germany ... 8628071[U]

[51] Int. Cl.[4] ..... B41F 31/06

[52] U.S. Cl. ..... 101/350

[58] Field of Search ..... 101/148, 349, 350, 351, 101/352, DIG. 6, 207–210

[56] References Cited

U.S. PATENT DOCUMENTS 3,683,805 8/1972 Harless ..... 101/350

FOREIGN PATENT DOCUMENTS 1000400 1/1957 Fed. Rep. of Germany .

*Primary Examiner*—J. Reed Fisher

[57] ABSTRACT

A shifting gear for the inkbox roller of a printing press having a freewheeling journal arranged on the roller axis including a drive pin connected to a slide block carried by the journal and a swingably borne slide block frame having a swinging axis connected with an oscillating drive to the press roller, the swinging axis of the slide block frame being shiftably arranged by a setting gear with respect to the drive pin of the freewheeling journal, and the setting gear having a setting sindle and drive nut connected with a bearing lever swingable on the machine frame and carrying the swinging axis of the slide block frame, the spindle having a setting groove whose pitch corresponds to the maximal setting range of the setting gear and the drive nut carrying a guide pin positioned in the setting groove. In the preferred embodiment, the setting spindle is connected with a turning grip and, with interposition of an indexing arrangement, the setting spindle is adjustable in small annular steps.

2 Claims, 2 Drawing Sheets

SHIFTING GEAR FOR THE INKBOX OF A PRINTING PRESS

FIELD OF THE INVENTION

The present invention relates generally to a shifting gear for the inkbox roller of a printing press and more particularly concerns such a gear which is adjustable between its maximal positions by a single turn.

BACKGROUND OF THE INVENTION

In inking mechanisms for printing presses, inkbox rollers are employed to bring the ink from an ink reservoir. To regulate the amount of ink transferred, it is necessary to adjust the drive turning speed of the inkbox roller. Ordinarily the inkbox roller is driven stepwise, since for each case only ink strips of small width are to be transferred from the inkbox to the inking mechanism. Corresponding, in the regulation of the turning speed of the inkbox roller, a fundamental adjustment is necessary of the step width. As one standard for the drive transfer, there has been developed an adjustable slide box guidance mechanism which is connected with an oscillating drive that is derived from the plate cylinder of the printing press.

A device of the above-mentioned type is described in German Pat. No. 1,000,400 as shifting gear for the inkbox roller of a printing press. There a freewheeling ratchet gear is journalled on the drive pin of the inkbox roller. To the drive pin of the freewheeling ratchet gear there is fastened a slide block that grips into a slide guide member which is arranged swingable on its one end on a pusher adjustably carried on the machine frame. In the slide guide member there engages a second slide block which is connected with a drive shaft derived from the machine drive as crank pin. For the adjustment of the pusher there is provided a setting spindle connected with the machine frame. By turning the setting spindle, the pusher and also the pivot axis of the slide block guide is shifted on the freewheeling ratchet relative to the slide block. Thus, the effective swinging path of the slide block guide on the freewheeling ratchet is made adjustable from 0 to a maximal swinging path. Because of the low pitch of the screw spindle thread, the shifting of this drive is, however, relatively expensive. In other words, from the least-positive ink ductor path to the maximal ink ductor path, a large number of revolutions of the setting spindle need to be carried out. Nevertheless, the extreme fineness of the possible setting provided by this arrangement is not at all necessary in actual practice.

OBJECTS AND SUMMARY OF THE INVENTION

The primary aim of the present invention is to provide a shifting gear for an inkbox roller which permits maximal adjustment between its end positions with only a single turn of the adjusting screw.

It is also an object to provide an indexing mechanism for incremental adjustments.

Pursuant to the invention, there is provided a shifting gear for the inkbox roller of a printing press having a freewheeling journal arranged on the roller axis including a drive pin connected to a slide block carried by the journal and a swingably borne slide block frame having a swinging axis connected with an oscillating drive to the press roller the swinging axis of the slide block frame being shiftably arranged by a setting gear with respect to the drive pin of the freewheeling journal, and the setting gear having a setting spindle and drive nut connected with a bearing lever swingable on the machine frame and carrying the swinging axis of the slide block frame, the spindle having a setting groove whose pitch corresponds to the maximal setting range of the setting gear and the drive nut carrying a guide pin positioned in the setting groove. In the preferred embodiment, the setting spindle is connected with a turning grip and, with interposition of an indexing arrangement, the setting spindle is adjustable in small angular steps.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
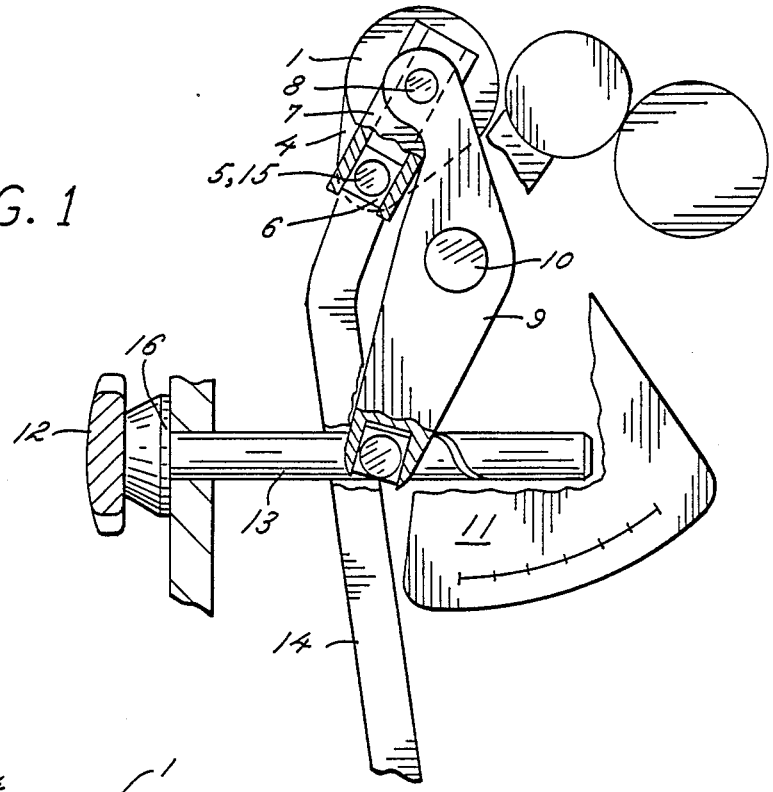
FIG. 1 is a fragmentary side view of a switching gear of the present invention shown in the position for maximal step width of the inkbox roller.

Turning now to the drawings, FIG. 1 shows the relationship of the switching gear of the present invention to the associated setting gear. As shown here, an inkbox roller 1 is disposed closely adjacent to a siphon roller and a further first inking mechanism roller. The inkbox roller 1 is provided on its axle 2 with a freewheeling journal 3. The freewheeling journal 3 is formed with a drive arm 4 which carries a drive pin 5. On the drive pin 5 there is seated a slide block 6. The slide block 6 is engaged in a slide frame 7. The slide frame 7 is swingably fastened to a swinging axle 8 seated on a bearing lever 9 which, in turn, is fastened to a bolt 10 swingably in the machine frame. The other end of the bearing lever 9 engages with a setting gear indicated generally at 11. The setting gear 11 consists essentially of a spindle-nut connection and an indexable turning grip 12. On turning of the spindle 13 of said spindle-nut connection, the bearing lever 9 is swung about the bolt 10.

The functioning of the switching gear will be described as follows: on the slide block frame 7, in addition to the slide block 6 and the swinging axle 8, a drive rod 14 is engaged. It is connected with a crank gear (not shown here) to the plate cylinder of the printing press. In operation of the printing press there is generated on the drive rod 14 an oscillating movement which is transferred over a drive bolt 15 to the slide block frame 7. This causes the slide block frame 7 to swing about its pivot axis 8. Depending on the relative position of the swinging axis 8 to the slide block 6, respectively the drive pin 5, on the freewheeling journal 3, the oscillating movement is transmitted in the form of a swinging movement of the slide block frame 7 to the freewheeling journal 3 and therewith to the inkbox roller 1. The relative position between the swinging axis 8 on the bearing lever 9 and the slide block 6 on the drive pin 5 of the freewheeling journal 3 is adjusted by the setting gear 11. By turning the setting spindle 13, the bearing lever 9 is swung about the bolt 10 fixed to the frame, whereby the position of the swinging axis 8 relative to the inkbox roller 1 changes, and therewith also relative to the drive pin 5 on the freewheeling journal 3. The adjustment can be shifted from a coaxial position between the swinging axis 8 and the drive pin 5 up to a maximal distance of the two elements at the other end of the slide block frame 7.

Figure 2:
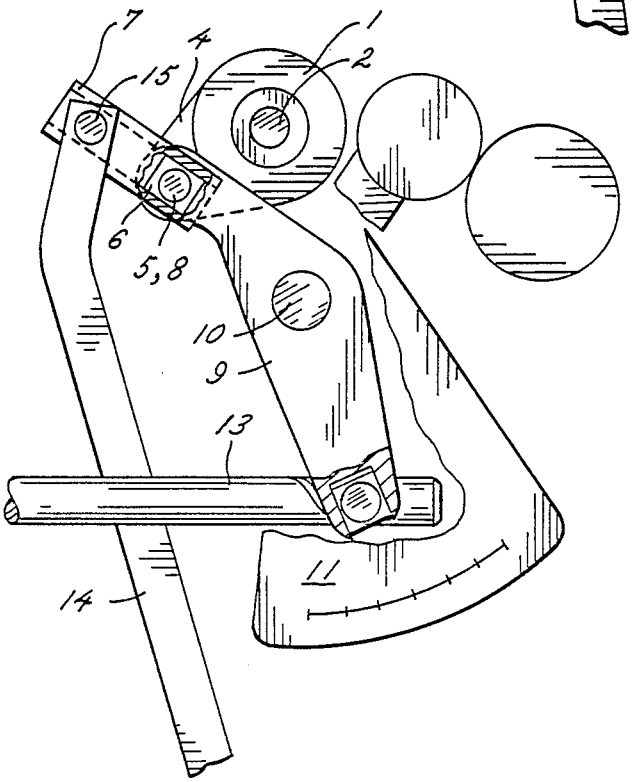
FIG. 2 is a similar view of the switching gear in the setting for minimal step of the inkbox.

In FIGS. 1 and 2, the maximal end settings of the switching gear are respectively illustrated. In FIG. 1 there is shown the setting at which the inkbox roller 1 is moved with maximal step width. Here the drive pin 5 and the drive bolt 15 coincide in the representation of the drawing. There the stroke of the drive rod 14 is transferred in full length to the drive pin 5 and therewith to the freewheeling journal 3.

In FIG. 2 there is shown the other end position of the setting gear 11. Here the pivot axle 8 and the drive pin 5 coincide, so that here the swinging movement of the slide block frame 7 about the pivot axle 8 cannot generate any movement on the drive pin 5. The inkbox roller 1 with running drive over the drive rod 14 remains standing. Between the two end positions shown in FIG. 1 and FIG. 2 a large number of settings are possible. These are determined by the fineness of the indexing arrangement 16 provided in the turning grip 12. The indexing arrangement 16 may be constructed for example as ball detent arrangement and prescribes the step width for the setting of the setting spindle 13.

Figure 3:
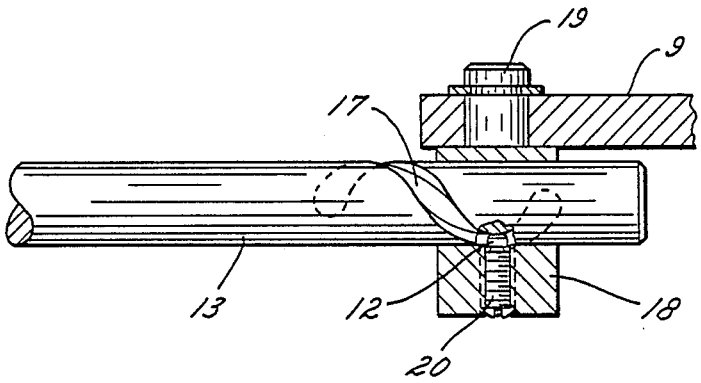
FIG. 3 is an enlarged, fragmentary detail of the spindle-nut connection of the switching gear.

In FIG. 3 the construction of the preferred embodiment of the setting gear 11 is illustrated in detail. The setting spindle 13 is provided with a setting groove 17 turning in a spiral shape. The setting groove 17 has a rectangular cross section and runs for only one turn about the setting spindle 13. It will be understood therefore, that the pitch of the setting groove 17 simultaneously corresponds to the maximal setting range of the setting spindle 13.

On the setting spindle 13 a drive nut 18 is stated. It is provided with a pivot 19, which engages into the bearing lever 9 and, in turn, carries the pivot axis 8 of the slide block frame 7. In the drive nut 18 there is inserted a screw 20 which is provided on its front end with a guide pin 21. The guide pin 21 is engaged in the setting groove 17 on the setting spindle 13. When the setting spindle 13 is turned, the drive nut 18, therefore, moves in the direction of the axis of the setting spindle 13 and thereby moves the bearing lever 9. In order to avoid compulsive forces, either the connection between drive nut 18 and bearing lever 9 must be movable transversely to the axis of the setting spindle 13, or the setting spindle 13 must be fastened swingably on the machine frame. The security against twisting of the setting spindle 13 is taken over the by indexing arrangement 16.

From the foregoing, it will be seen, therefore, a very simple arrangement for shifting the switching gear of an inkbox roller 1, is provided which makes possible a rapid adjustment with a small angle of rotation of the setting spindle 13.

Figure 4:
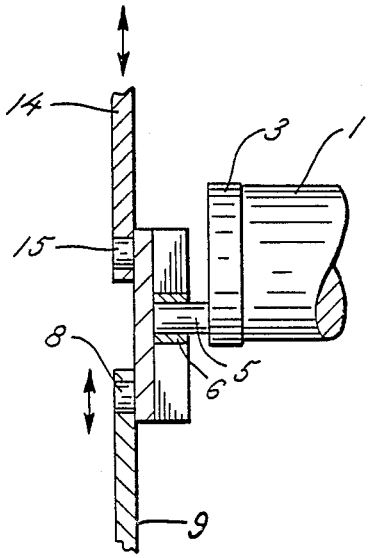
FIG. 4 is a fragmentary view of the slide block connection to the inkbox roller in partial longitudinal section.

In FIG. 4, for clarification, there is once again illustrated the coupling of the switching gear over the slide block frame 7. The slide block frame 7 is shown here in longitudinal section and on the slide block frame 7 there the pivot axle 8 is mounted. The pivot axle 8, in turn, is connected with the bearing lever 9, the slide block frame 7 being swingable with respect to the bearing lever 9. With a likewise movable connection, the drive rod 14 is connected over the drive bolt 15 with the slide block frame 7. In the illustration here, all the lever connections are folded into one plane, so that their kinematic disposition does not truly agree with reality. The connection to the inkbox roller 1 is established over the slide block 6, the drive pin 5 and the freewheeling journal 3 connected thereto (here, however, only schematically indicated). The drive movement is transferred from the drive rod 14 provided with a double arrow to the slide block frame 7, which swings about the pivot axis 8 and, in the process, according to the relative position between pivot axis 8 and drive pin 5 carries along the slide block 6 more or less far; the relative position being determined by the position of the pivot axis 8 which is designated with a second double arrow.

We claim as our invention:

1. A shifting gear for the inkbox press roller of a printing press having a freewheeling journal arranged on an axis of the roller, comprising, in combination, a machine frame, a drive pin connected to a slide block carried by said journal and a swingably borne slide block frame having a swinging axis connected with an oscillating drive to the press roller, the swinging axis of the slide block frame being shiftably arranged by a setting gear with respect to the drive gear of the freewheeling journal, said setting gear having a setting spindle and drive nut connected with a bearing lever swingable on the machine frame and carrying the swinging axis of the slide block frame, said setting spindle having a setting groove whose pitch corresponds to the maximal setting range of the setting gear and said drive nut carrying a guide pin positioned in said setting groove.

2. A shifting gear as defined in claim 1 wherein the setting spindle is connected with a turning grip and, with interposition of an indexing arrangement, the setting spindle is adjustable in small angular steps.

* * * * *